US006176291B1

(12) United States Patent
Sanchez et al.

(10) Patent No.: US 6,176,291 B1
(45) Date of Patent: Jan. 23, 2001

(54) MOTOR-DRIVEN REVERSIBLE SHUTTER

(75) Inventors: Francisco Lujan Sanchez; Emiliano Martin Gomez, both of Toledo (ES)

(73) Assignee: Ceraper, S. L., Toledo (ES)

( * ) Notice: Under 35 U.S.C. 154(b), the term of this patent shall be extended for 0 days.

(21) Appl. No.: 08/871,619

(22) Filed: Jul. 31, 1997

(51) Int. Cl.[7] ..... E05F 15/00
(52) U.S. Cl. ..... 160/188; 160/36; 160/201
(58) Field of Search ..... 160/32, 133, 85, 160/37, 36, 214, 201, 188

(56) References Cited

FOREIGN PATENT DOCUMENTS 2 854 928 * 6/1979 (DE) .
0 508 931 A2 * 10/1992 (EP) .
0 619 411 A2 * 10/1994 (EP) .
2 413 534 * 7/1979 (FR) .
2 704 273 * 10/1994 (FR) .

* cited by examiner

*Primary Examiner*—Blair M. Johnson
(74) *Attorney, Agent, or Firm*—John C. McMahon

(57) ABSTRACT

Motor-driven reversible shutter of the type composed of a plurality of slats coupled to one another by means of an end hook and channel and which moves along a channel of a labyrinthine trajectory formed on the inner face of respective side plates mounted in correspondence with the ends of the shutter box, each slat end including a part with lateral spaced-apart appendices for the purpose of inserting therebetween the teeth of pinions mounted in specific points along the labyrinthine trajectory channel and designed to draw the slats which, on moving along said labyrinthine trajectory reveal one face while moving in one direction and the opposite while moving in the other direction, thus providing the shutter with its reversible character. A tubular axis of a polygonal configuration is installed between both side plates, rotating when driven by an internal motor, characteristic in that, integral to the ends of said tubular axis, respective crowns are fitted which engage and drive pinions on whose axes are mounted the pinions drawing on the slats, the crowns and the meshing pinions being located on the external face of the side plates; three micro-switches being provided for deactivating and stopping the drive motor in the extreme open and closed positions, two located at the entry of the labyrinthine trajectory channel and one at the exit of the labyrinthine trajectory channel. The end walls of the shutter box include attachment means for a special part of a generally prismatic shape which constitutes, at the lower portion of each side, the means of associating the side walls along which the shutter advances before and after the labyrinthine trajectory, said part furthermore constituting a means of securing the plates fitted with the labyrinthine trajectories; said side walls also being provided at their inner face with pairs of profiles, one upper and one lower, wherein the channels are formed which permit the single-block assembly formed by the shutter, the labyrinthine trajectory side plates, the driving axis and the corresponding transmission and drawing means to be slidingly mounted inside the box.

9 Claims, 7 Drawing Sheets

MOTOR-DRIVEN REVERSIBLE SHUTTER

The invention relates to a motor-driven shutter, its novel characteristics affecting the means that allow the shutter to be motor driven, the shutter assembly box and the coupling means between the slats which compose the shutter itself.

The object of the invention is to provide a reversible shutter (which can be cleaned from the same side, in view that, depending on the direction of the movement, the shutter discloses one surface or the other) that is driven by a motor and which furthermore may be installed as a single-block assembly inside the built-in box through the use of appropriate mounting means.

The shutter being advocated is based on a reversible type of unit mounted between plates provided at the ends of the shutter winding or concealment box, the shutter slats incorporating at the ends thereof parts fitted with cylindrical appendices which emerge laterally, spaced between each other through an appropriate gap so that pinion teeth are inserted between said appendices which, upon rotating, draw on said parts and cause the slats to move, being particular in that said appendices fitted at the ends of the slats extend and are guided along labyrinthine channels provided for that purpose at the inner faces of the end plates fixed at the ends of the box. Said labyrinthine shutter slat guiding/sliding channels comprise an entry and an exit which, at the bottom, converge in a common channel fitted as a continuation of the channel provided at each side of the window hollow for guiding the shutter while it is being winded (opening the shutter) or unwinded (closing the shutter).

The type of shutter described is intended and conceived for manual operation; that is to say, through a corresponding belt which causes the rotation of an axis on which a crown is fitted which engages pinions on whose axes are mounted, at the other side of the plate, the pinions which draw the slats.

This type of reversible shutter is composed of hollow slats of a rectangular section, additional coupling means being provided at the ends or upper and lower edges thereof, said coupling means being constituted by an extension in the form of a hook fitted onto one edge or end, and a straight channel of a rectangular section fitted at the opposite edge for the entry and coupling of the hook.

The shutter built around this type of slat presents certain drawbacks from the standpoint of the darkening function, namely that an efficient closure cannot be achieved in order to prevent the passage of light. Furthermore, the configuration of the coupling means provides poor or improper operation because of the deficient accommodation between said coupling means as a result of the labyrinthine path which produces continuous changes in the trajectory of the movement.

To the above problems and inconveniences must be added the difficulty involved in mounting the shutter, with all its components, inside the corresponding box.

Based on said reversible shutter concept, this application claims, in a first aspect, improvements designed to achieve motorized operation of the shutter, i.e. that it be motor driven.

Toward this end, it is foreseen that the crown which causes the pinions to rotate be mounted on a tubular axis of a polygonal section which is made to rotate by means of a cylindrical motor located inside it, the rotation of said tubular axis, and consequently of the crown mounted on it, being transmitted to the pinions on whose axes are in turn mounted the slat-drawing pinions. Transmission is advantageously achieved from a crown to a pinion and from the latter to a second crown engaging a second pinion, in the event that two pulling pinions are provided; if more pinions are needed as a result of the shutter having a considerable length, both crowns may engage one, two or more pinions.

Evidently, the shutter's fully winded or fully unwinded positions are established by stoppers, so that instead of said end of trajectories corresponding to the motor, in the conventional manner, said stoppers are defined by micro-switches which for connection and disconnection purposes are activated by the shutter's end slats, said slats being provided with projections which, on passing the points wherein are located the micro-switches, act on them and thus close the motor-feeding circuit, said micro-switches being functionally associated in a way that when one is activated the other(s) is/are deactivated, and vice-versa.

More specifically, in the labyrinthine channel which determines the guide along the path of the shutter, three micro-switches are provided arranged in a way that one of them is activated when the shutter reaches its closed position; another is activated when the shutter reaches its open position; while the third is activated when the shutter again reaches its closed position in the course of its reverse trajectory. Said micro-switches are obviously mounted in specific points along the labyrinthine path so that they are activated precisely when the first and last slats, which are the slats fitted with the micro-switch activation projections, pass said points. The connection of the micro-switches is furthermore conducted in a way that they operate either in combination or independently for the opening and closing of the circuit feeding the motor, thus stopping or activating the motor. It should also be noted that the motor can be stopped at any moment via the corresponding on/off switch, detaining the shutter at any point in its trajectory, i.e. partially open or raised.

Another novel feature of the shutter corresponds to the slats that make up the shutter, and more specifically to a series of improvements introduced therein.

One improvement consists in that the inner surface of the arched extension which constitutes the coupling element in one of the slat edges is concave instead of flat, as in prior art slats. Said concave surface is complementary to a convex surface which defines a fin that delimits, on one side thereof, the channel provided at the opposite edge for coupling said extension. These complementary curves provide a hinge effect and movements in a way that the slats are not affected by path changes along the labyrinthine trajectory.

Furthermore, said channel is delimited along the other side by and arched fin, the free edge of which tends to converge and lean over an ample step formed by an arched extension acting as a hook which enables closure without fissures, that is to say, a closure providing total darkness.

Additionally, the end slats, both upper and lower, finish in a strangled rectangular channel shape for the installation of draught excluders or joints which not only perform as shock absorbing supports but also provide a closure that is free of fissures.

Another aspect of the invention refers to the shutter box and the way in which the shutter assembly is mounted inside it, this aspect being considered as part of another series of improvements relating to the shutter.

One of the improvements consists in that the sides or end walls of the box, mounted during the masonry construction above the upper part ot the window hollow in which the shutter is installed, incorporate along their inner face a pair of profiles arranged to define an upper channel and a lower channel which face each other for the sliding assembly of the corresponding lateral plates along the labyrinthine path and which furthermore carry the pinions and crowns which drive the rotation means via the transverse axis fitted between the plates. The assembly made up of these components, forming a single-block assembly, is mounted in the box by sliding the upper and lower plate edges in the labyrinthine paths along the channels forming the profiles integral to the inner face of the end walls or sides of the box.

Furthermore, in another basic improvement, a pair of special parts are arranged in correspondence with the lower part of the sides, said parts constituting a means of attaching the labyrinthine path plates and the intermediate means associating the guide in each side and the box end wall itself. Said parts are fitted with a prismatic section with lateral undercuts for the guided introduction in a profile recess which constitutes said lateral guide. Also, they comprise a window or recess insertion and attachment tab provided in the corresponding lower corners of the end walls of the box, a groove also being provided wherein a fin is lodged and attached, located at the lower edge of the plates with the labyrinthine trajectories. Finally, the parts are fitted with front extensions and an intermediate projection which determine the start of each shutter path in its entry and exit trajectories in respect to the corresponding labyrinthine path or trajectory.

Said improvements, once the box is mounted in the course of the construction work, allow the shutter assembly to be installed as a single block after installing and fixing the part between each end wall of the box and the corresponding vertical guide.

The attached drawings represent, by way of example, a preferred form of embodiment of the reversible shutter with the above novel features, wherein the following is shown:

Figure 7:
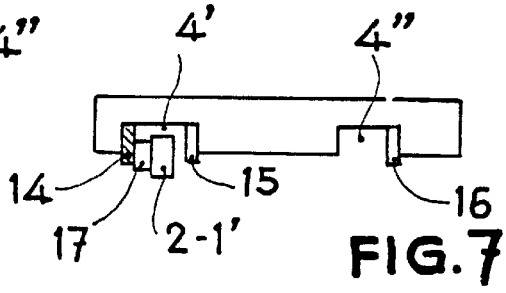
Figure 8:
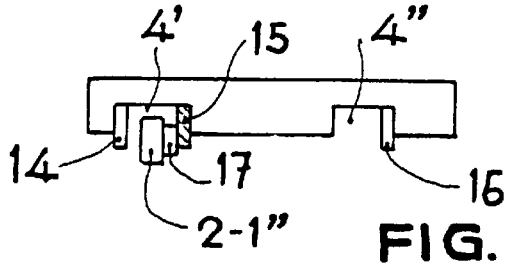
Figure 9:
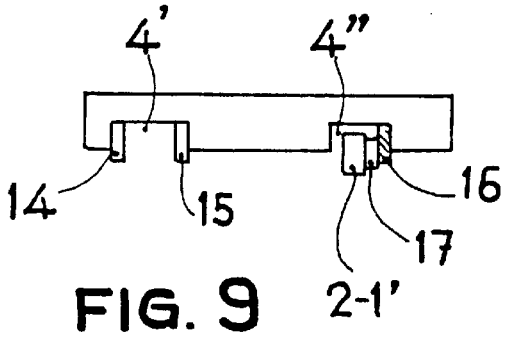

FIGS. 7, 8 and 9 show respective details of the micro-switch operation, the first case corresponding to the position of the closed shutter, the micro-switch being activated by the projection in the first slat. In the second case, the micro-switch is activated by the projection of the last slat, corresponding to the raising or opening position. In the third case, the micro-switch is activated by the projection in the last slat during the reverse trajectory of the shutter.

Figure 10:
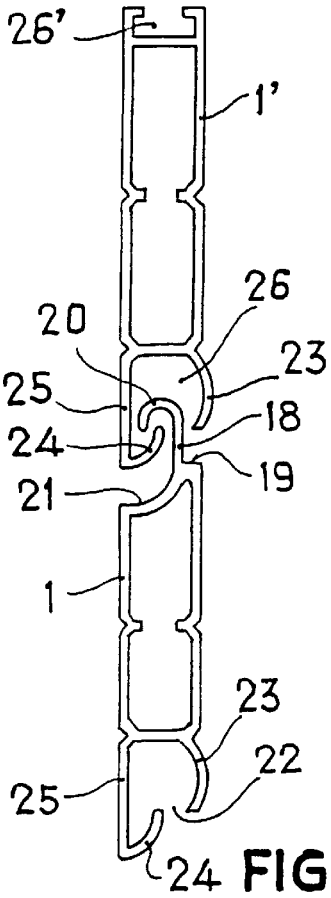

FIG. 10 shows a side view of the slat which forms a part of the inventive shutter coupled onto another slat which corresponds to the upper slat in the same shutter.

Figure 11:
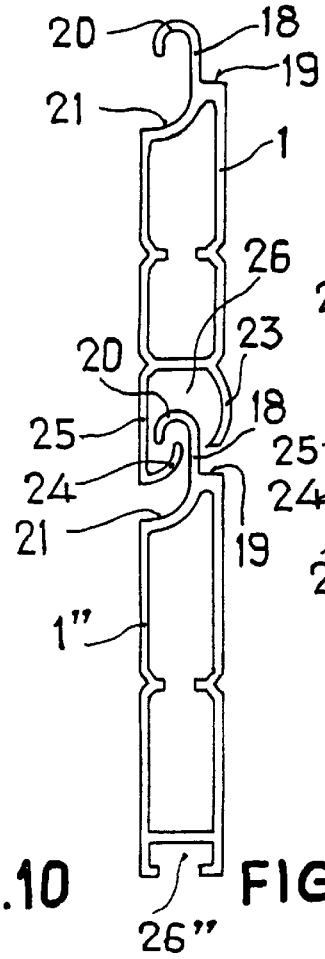

FIG. 11 shows the same slat shown in the previous figure, coupled onto another slat considered to be the shutter's lower slat.

Figure 12:
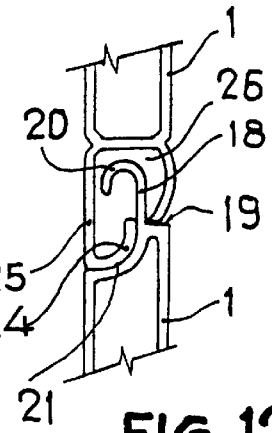

FIG. 12 shows a detail of the coupling between slats in the closed position.

Figure 13:
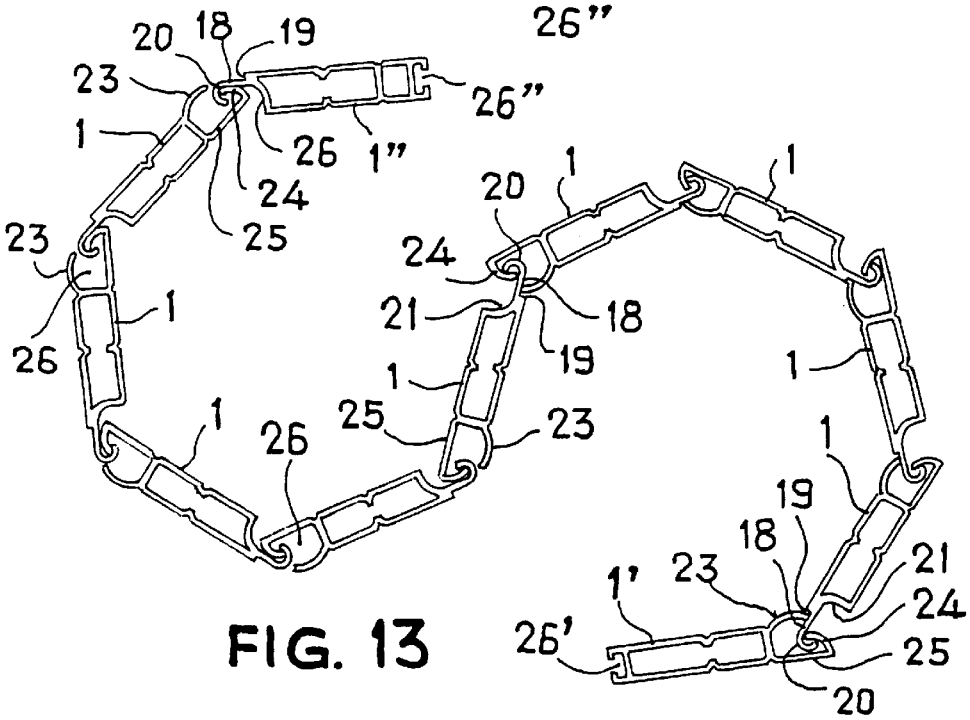

FIG. 13 shows a detail of various coupled slats after the changes in the path which may correspond to a labyrinthine trajectory.

Figure 14:
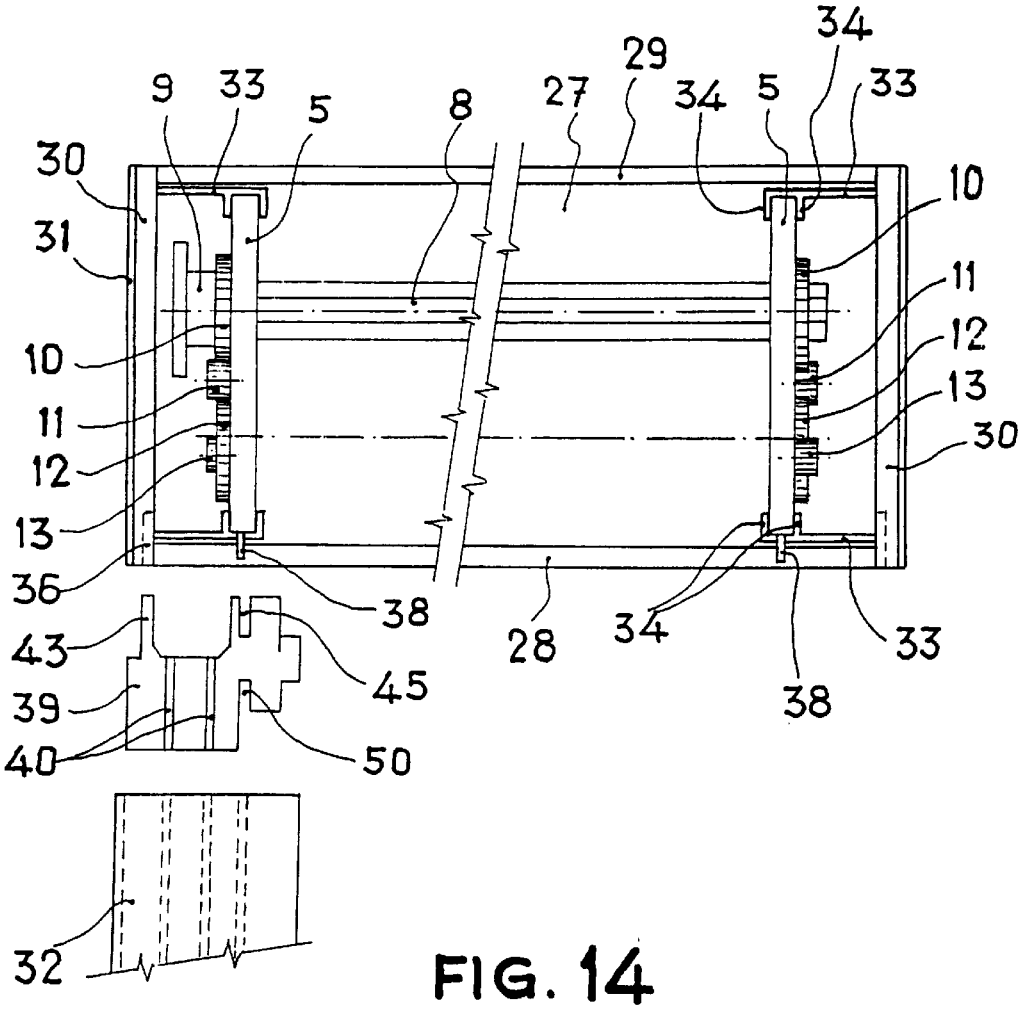

FIG. 14 shows a front view of the shutter box and assembly, without the slats although in mounted condition. This figure also shows the special part joining the vertical guide and the end wall in the box which also serves to attach, onto each side, the plate provided with the corresponding labyrinthine trajectory.

Figure 15:
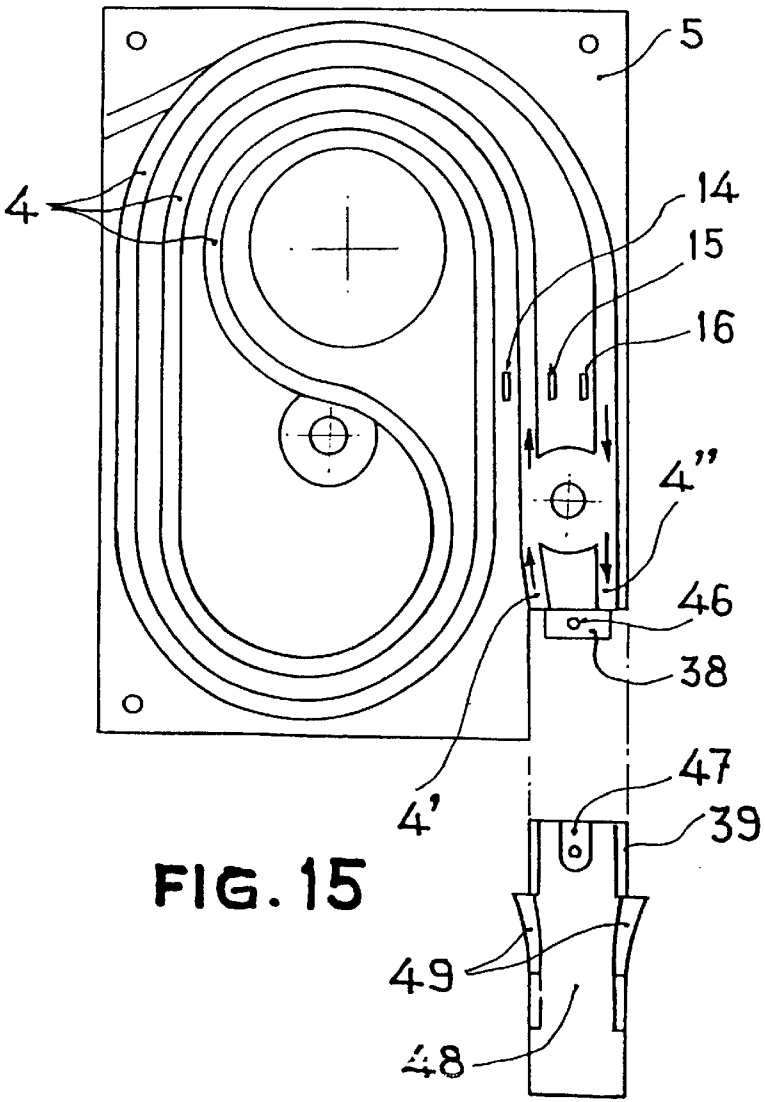

FIG. 15 shows a view of one of the plates provided with the labyrinthine trajectory, as well as the lower extension determining the vertical guide on that side.

Figure 16:
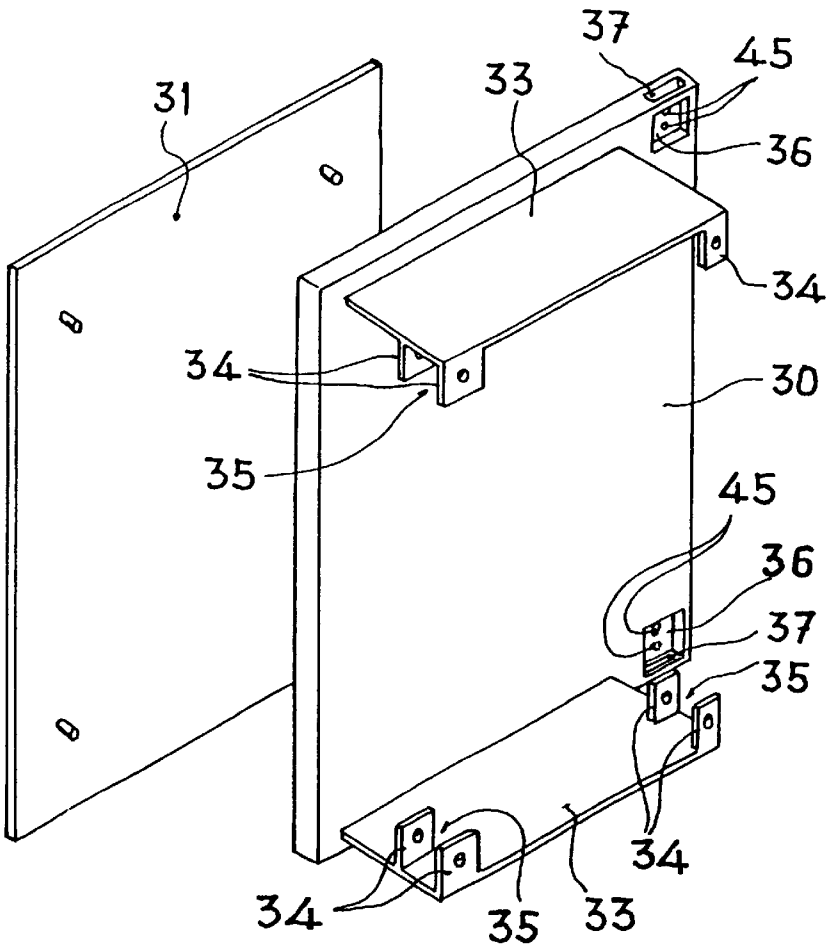

FIG. 16 shows an exploded perspective view of one of the box end walls and the corresponding cover.

Figure 17:
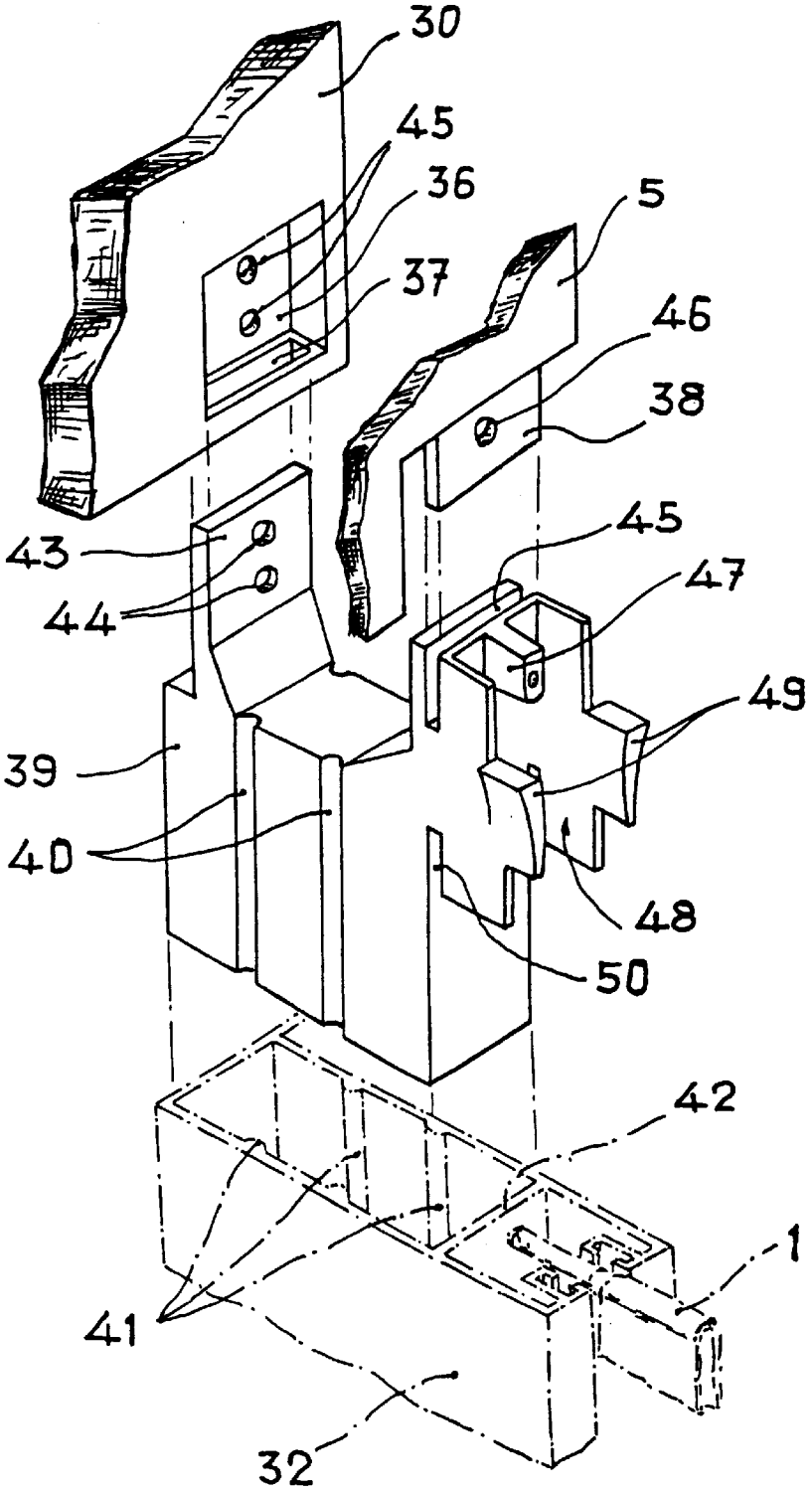

Finally, FIG. 17 shows an exploded view of the special part, of the end portions of the end wall in the box and of the plate provided with the labyrinthine trajectory.

As can be seen from the above figures, the inventive shutter is of the type known as reversible, being composed of a plurality of slats (1), the slats (1') and (1") being the end slats (upper and lower). Each slat (1), (1') and (1") is fitted at the ends thereof with respective parts (2) mounted through insertion, said parts (2) being fitted on their external portion with cylindrical appendices (3) which project laterally and are evenly spaced in respect to each other. These appendices (3) allow the slats (1), and thus the shutter, to be drawn, and also constitute the guiding means for the sliding of the shutter, said appendices (3) being located in the corresponding labyrinthine trajectory channel (4) formed in the inner plate of the two side plates (5) mounted at the ends of what will constitute the corresponding shutter box. Along points duly established in the labyrinthine trajectory (4), and depending on the length of the shutter, pinions (6) are installed, between the teeth of which are located the appendices (3), the rotation of said pinions (6) providing the shutter with its drawing motion.

The labyrinthine trajectory or pathway (4) presents an entry (4') and an exit (4"), both of which converge on the vertical channel (7) fitted on each side of the shutter hollow for the sliding of the shutter.

According to the description provided thus far corresponding to the general characteristics of a reversible shutter, the object of the invention is to provide adequate means for the motorized driving of the reversible shutter. Toward this end, it is foreseen that, between the two lateral plates (5), a tubular axis or shaft (8) of a polygonal configuration is mounted and made to rotate by a cylindrical motor (9) mounted in correspondence with the end portion of the axis (8) and fitted at both ends thereof with respective crowns (10) located on the external side of each lateral plate (5). Each crown (10) engages a pinion (11) which in turn engages a second crown (12) which drives another pinion (13). Thus, on the axes of these pinions (11) and (13), the drawing pinions (6) are in turn mounted and located on the other side, namely on the inner side of the side plates (5).

Thus, each time the motor (9) is activated, the axis (8) begins to rotate and with it the crown (10) which, through the pinions (11) and (13), transmit rotation to the pinions (6) which, upon engagement between the appendices (3), draw the slats and consequently causes the shutter to move along the labyrinthine trajectory channel (4).

So that the motor (9) will stop at the closed and open positions of the shutter, three micro-switches (14), (15) and (16) are provided at the labyrinthine trajectory along the passage of the slats (1), (1') and (1"), said micro-switches being activated by a projection (17) in the end slats (1') and (1").

FIGS. 7, 8 and 9 show the operational sequences according to the specific positions of the micro-switches (14), (15) and (16) at the passage of the end slats (1') and (1") and consequently at the passage of the projection (17) acting on said micro-switches.

Figure 1:
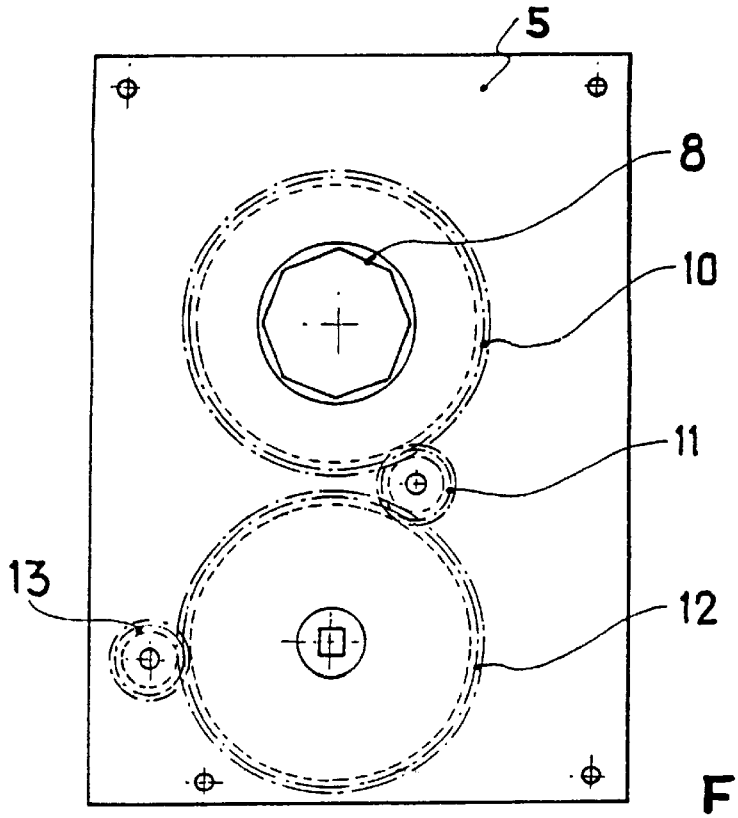
FIG. 1 shows an external side view of one of the sides or plates provided at the ends of the shutter box and showing the engaging means for the motorized driving of the shutter in question.
Figure 2:
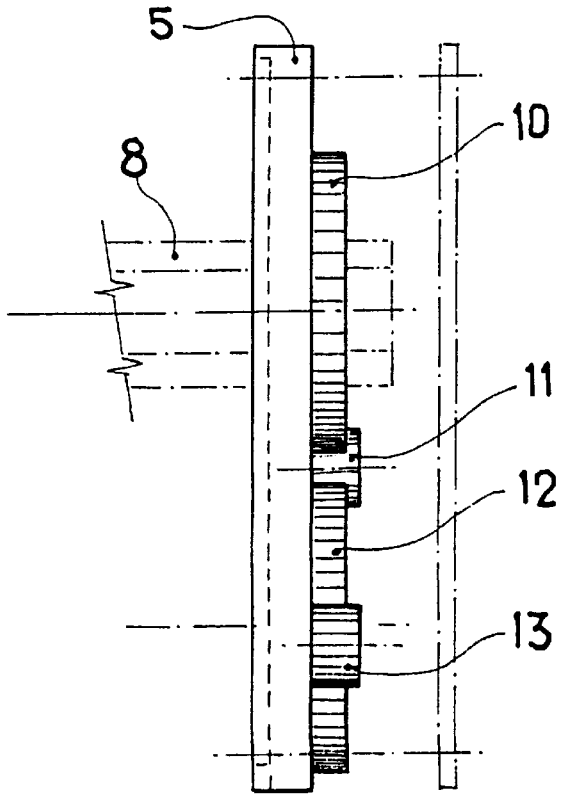
FIG. 2 shows a side view corresponding to the side shown in the previous figure.
Figure 3:
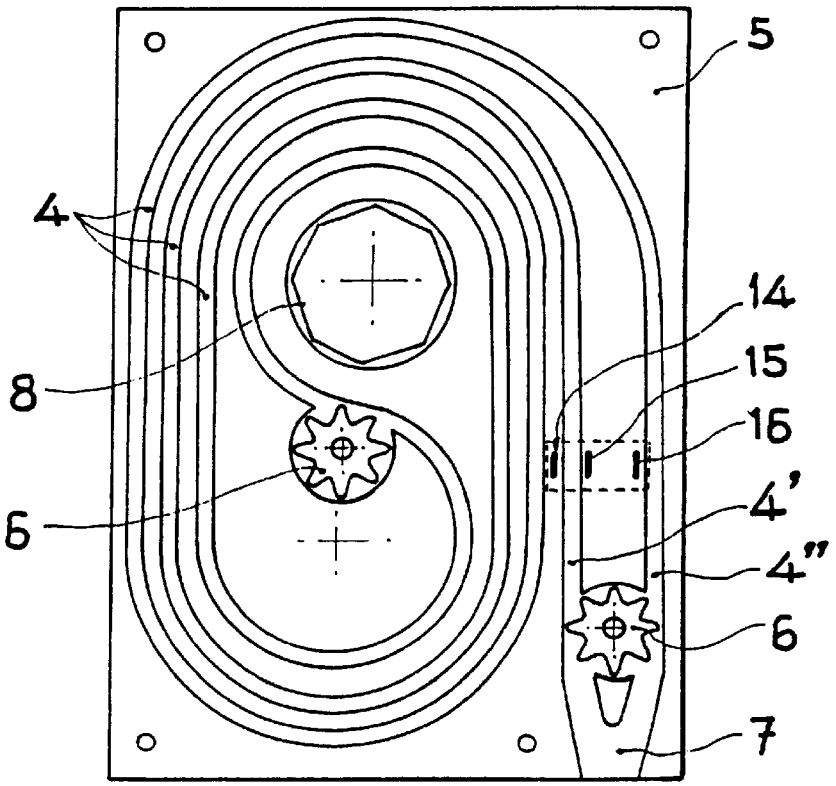
FIG. 3 shows the inner face of the side or plate shown in the previous figures, revealing the labyrinthine guiding path along which the shutter moves, and the pinions arranged along this path for drawing the shutter.
Figure 4:
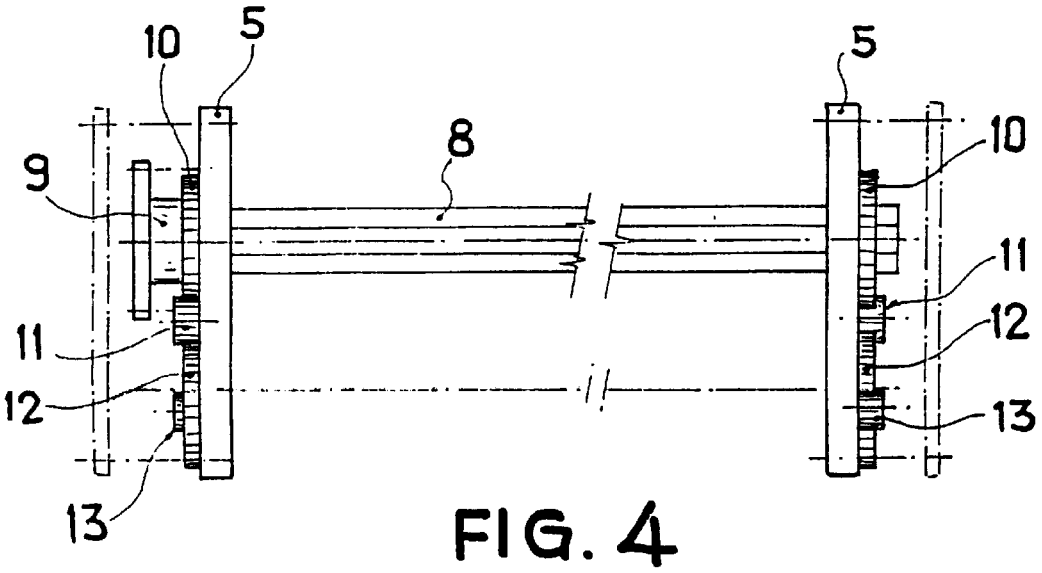
FIG. 4 shows a side elevation of the sides or plates along which the shutter advances, as well as the tubular body of a polygonal section arranged between said sides and over which a driving motor acts to draw on the shutter.
Figure 5:
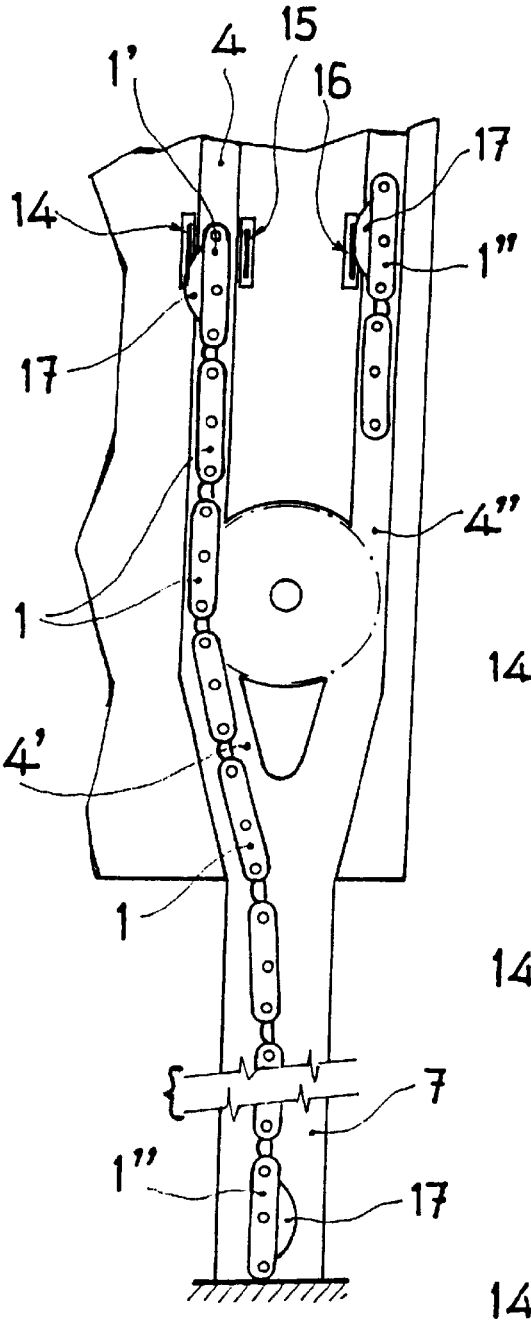
FIG. 5 shows a detail of the entry of the vertical channel that guides the shutter, at which entry the ends (entry and exit) of the labyrinthine path channel converge into the channel that guides the shutter and along which it moves in its winding (rolling-up) or unwinding (unrolling or closing) motions. This figure shows the location of the three micro-switches.
Figure 6:
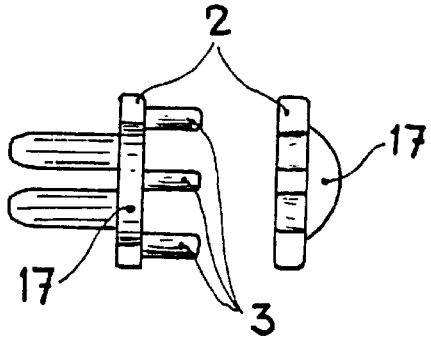
FIG. 6 shows end and side details of the part fitted at each end of the shutter slats for driving the shutter.

Operation is as follows:

Once the motor (9) is switched on—for instance from the shutter's open position—and as the shutter reaches the closed position corresponding to that shown in FIG. 5, the projection (17) in part (2) at the end slat (1') acts on the micro-switch (14) and causes the circuit to open and thus the motor (9) to stop. This position corresponds to the sketch shown in FIG. 7.

If from the closed position shown in FIG. 5 the motor (9) is activated once again, the shutter will be drawn to the open position, said open position being obviously achieved once the slat (1") has exceeded the upper end of vertical channel (7), namely when said slat (1") reaches a position wherein the projection (17) in part (2) of the slat (1") faces and acts on the micro-switch (15) to open the circuit and cause the motor (9) to stop in the position corresponding to the detail shown in FIG. 8.

If from the open position the motor (9) is activated again more after acting on the switch, the shutter is once again drawn to the closed position, although, as a result of it being guided along the labyrinthine trajectory (4), a turn will be effected through exit length (4") instead of length (4') as on the previous occasion, the reversibility of the shutter being thus obtained. Consequently, in this inverse or reversible trajectory of the shutter, the projection (17) of part (2) corresponding to slat (1") acts on the micro-switch (16) and causes the circuit to open and the motor (9) to stop, said position corresponding to the detail in FIG. 9.

Said motor (9) may be stopped at any time simply by acting on the corresponding on/off switch, allowing the shutter to remain in any intermediate point in its trajectory.

FIGS. 10, 11, 12 and 13 show the characteristics of the slats (1), (1') and (1"), as well as the details corresponding to the intermediate coupling means.

Said figures show that the slats (1) are hollow and of a rectangular section, one of its edges or ends presenting an extension (18) that is offset in respect to the side to form an ample step (19) with the side. Said extension (18) ends in an elbow that is rounded inward and forms a kind of hook (20). The end surface of the slat, before the extension (18), is concave-curved (21) for reasons which will be explained further on.

The opposite end or edge presents an opening (22) established between the respective edges of wings (23) and (24), wing (23) being arched, whereas wing (24) is formed by an arched extension inward of side (25), the external curve of said wing (24) being complementary to the concave surface (21), both adapting to one another when closure is effected, as can be seen in FIG. 12.

According to the characteristics of the slat thus described, the assembly of a shutter may be undertaken by simply coupling a plurality of slats among each other in a correlative manner, as can be seen in FIG. 13.

This engagement is achieved by inserting the hook (20) in a slat (1) through the opening (22) corresponding to the opposite edge of the adjacent slat. Owing to the special configuration established by the wings (23), (24) and the opening (22), the hook (20) lodges inside the corresponding channel (26), so that when the slats tend to become disengaged the hook (20) engages the wing (24) and avoids possible disengagements, the attachment being ensured by the backstop provided by the free end of wing (23) against which abuts the external part of said hook (20), or of the extension (18) of which it forms a part.

In the closing or overlapping of the slats, the complementary surfaces of wing (24) and concave length (21) become adapted to one another and remain perfectly superimposed; also, the free end of wing (23) leans perfectly on step (19) and thus precludes the entry of light therethrough, operation of the shutter being enabled without any difficulty.

The upper (1') and lower (1") end slats which complement the shutter, in addition to the engagement channel in the former and the hook in the latter, are fitted with external channels (26') and (26"), respectively, strangled at the mouth for the purpose o lodging and retaining a gasket or draught excluder acting as an insulating closure element which leans on the upper or lower part, depending on the portion of the shutter.

Concerning box (27) for mounting the shutter assembly, in the form of a single block, it comprises a base panel (28), a cover panel (29) and a pair of end walls or sides (30), said parts being complemented with respective external covers or fancy design elements (31).

In turn, the reversible shutter assembly as such comprises: the pair of side plates (5), the inner sides of which contain the respective labyrinthine trajectories (4); a polygonal axis (8) between said two plates (5) for the winding/unwinding of the shutter as a result of the fact that said axis (8), upon being driven, causes the pinions and crowns (10, 11, 12, 13) to rotate and in turn drive the slat drawing means via the appendices or engaging elements provided at the ends of said slats. These pinions, crowns, drawing elements and the slats themselves are also comprised in the shutter single-block assembly.

Along the labyrinthine trajectory (4), entry of the slats or shutter corresponds to reference (4') and exit to reference (4"), whereas the lower vertical guide in each side, forming an extension of the labyrinthine trajectory, is referenced by (32).

Based on these characteristics, the inner face of each end wall (30) is provided with a pair of profiles or holders (33), one upper and one lower, in each of which are established wings (34) which in each case determine a channel (35), both channels (35) facing each other for the sliding assembly of the plates (5) and consequently of the single-block shutter assembly. It is also contemplated that one of the corners, either upper or lower, in each end wall (30) be fitted with a recess (36) and a window (37) connecting with said recess, the function of which shall be described further on.

The lower edge of the plates (5) is fitted with a fin (38), the function of which shall also be discussed.

The invention is additionally and mainly characterized in that it incorporates a special part or connector of a generally prismatic configuration (39), the larger lateral faces of which are provided with recesses (40) complementary to the projections (41) in the inner face of the walls which delimit the lodging of guide (32), precisely at which point said part (39) is installed by insertion, the upper portion of the part being provided with an extension or wing (43) passing across the window (37) and becoming located in the recess (36) corresponding to the end wall (30). The guide profile (32) is thus associated to the end wall (30) on each side, the part (39) being secured by screws passing through holes (44) and (45) in a face to face arrangement in the extension or wing (43) at the bottom of recess (36).

At the opposite portion of said part (39), and also in correspondence with the upper portion, a groove (45) is provided for receiving the fin (38) in plates (5). This means that, once part (39) is mounted between the box guide profile (32) and the end wall (30), becoming attached to the box as previously described, the shutter assembly is mounted as a single block by sliding the plates (5) along the channels (35), the fin (38) being lodged in groove (45) and secured by means of screw passing through the hole (46) of said fin (38) and also passing through the hole in the separating projection (47), the latter being provided in channel (48) on order to establish the entry (4') and exit (4") of the labyrinthine trajectory (4). Said channel (48) is laterally escorted by slightly curving partitions (49) which warp in a divergent manner for the purpose of guiding the corresponding slats (1) as they advance upwards and downwards.

Finally, in part (39), a groove (50) is likewise provided for receiving the upper part of partition (42) of guide profile (32).

What is claimed is:

1. A motor driven reversible shutter with a pair of side plates and a plurality of slats coupled to one another to form a shutter unit; each of said side plates including a guide channel having a beginning and an end and a labyrinthine pathway therebetween and being located on an inner side of respective side plates; each slat having a pair of ends and a channel follower part being mounted on each respective slat end; each of said channel following parts including pinion followers; said shutter including rotatable drive pinions mounted at locations along said guide channel such that said pinion followers operably follow said pinions as said pinions rotate so as to draw said slats along said guide channel; said slats being flexibly joined and forming a first shutter face when moving along said guide channel in a first direction and a second and different shutter face when moving along said guide channel in a second direction opposite said first direction, such that said shutter is reversible; said shutter further including a rotatable shaft mounted between said side plates that is selectively rotatable by a motor; said shaft being interconnected with each of said drive pinions so as to selectively rotate said pinions and thereby control direction of movement of said slats; said shutter further includes first, second and third micro-switches; said first and second micro-switches being located at the beginning of said guide channel on respective opposite sides thereof and said third micro-switch being located on the end of said guide channel; at least one of said slats having a projection therefrom to engage and operate said micro-switches; said micro-switches being cooperatively linked to and controlling said motor so as to stop said motor after said slats pass along said guide channel to a preselected position.

2. The shutter according to claim 1 wherein:

a) said projection is a first projection located on a slat near a first end of said shutter element and positioned to activate said first micro-switch as the shutter element becomes positioned adjacent said first micro-switch; a second of said slats near a second end of said shutter element having a second projection; said second projection positioned to activate said second micro-switch when said shutter element becomes positioned adjacent said second micro-switch; said first and second micro-switches stopping said motor when activated.

3. The shutter according to claim 1 wherein:

a) each of said slats have a hook along one side thereof and hook receiver on an opposite side thereof; said hooks and hook receivers extending substantially across the width of a respective slat; the hook and the hook receiver of each adjacent pair of slats mating to flexibly join each of said pairs of slats together; each of said slats having front and rear opposed sides; each of said hooks being joined to a respective slat in spaced relationship to at least one of said opposed sides forming a wing engaging shoulder on one side thereof; said hook receiver having a side and a first wing spaced from each other and converging at one end of each to form a hook receiving slot while also forming a hook receiving chamber therebetween; each of said first wings being positioned opposite a respective wing engaging shoulder of an adjacent slat; each of said hook receiving chamber sides also including an inwardly projecting second wing with said first and second wings capturing a respective hook so as to allow such a hook to flex within the respective hook receiving chamber, but remain therein during movement of the shutter unit in such a way as to prevent light from passing between adjacent slats.

4. The shutter according to claim 3 wherein:

a) each slat has a central body with an outward facing concave surface thereon formed alongside each hook opposite a respective shoulder; said second wing sized and shaped to slidingly mate with said concave surface at times during movement of said shutter unit, such that when adjacent slats are touching said second wing can slide along said shoulder and when bodies of adjacent slats are spaced, said hook is trapped by said second wing to prevent total separation between such adjacent slats.

5. The shutter according to claim 1 wherein:

a) said side plates are positioned in parallel relationship to each other; and including:

b) a shutter box for receiving said side plates; said box including a pair of spaced walls; each of said walls having an inwardly projecting holder near top and bottom ends thereof; each of said holders on a wall having facing mounting channels sized and shaped to slidingly receive respective plates for slidably mounting said plates, shaft, pinions, slats and motor as a single group in said box.

6. The shutter according to claim 1 including:

a) a connector operably connecting one of said side plates to an adjacent wall of a shutter box at an end of said guide channel; said connector having first and second parallel walls and a body portion; said body portion having a first part of a tongue and groove juncture;

b) a guide for said shutter element having a second part of a tongue and groove juncture to allow said guide to slidingly receive said connector; and c) said side plate having a window with a first of said connector walls being received and secured in said window.

7. The shutter according to claim 6 wherein:

a) one of said side plates includes a lower fin; and b) said connector second side wall having a groove operably receiving said fin; and wherein c) a fastener is utilized to secure said fin to said second side wall; and d) further wherein said connector has extending therefrom a pair of arches that bow outwardly to operably function as guides for said shutter unit upon entry and exit from said guide channel.

8. The shutter according to claim 1 including:

a) a box having a pair of spaced side walls; each of said side walls having an upper and a lower holder having facing mounting channels that are sized and positioned to slidingly receive a respective side plate; said mounting channels guiding and then holding a respective side plate during assembly and providing structure to secure a respective side plate to a holder with a fastener.

9. The shutter according to claim 1 wherein:

a) said guide channel has a first portion and a second portion joined by a third connecting curved portion; said first and second portion being parallel and closely spaced.

* * * * *